US007984530B2

(12) United States Patent
Reynolds et al.

(10) Patent No.: US 7,984,530 B2
(45) Date of Patent: Jul. 26, 2011

(54) PET WASTE VACUUM SYSTEM AND APPARATUS, DISPOSABLE LINERS THEREFOR, AND A METHOD OF COLLECTING PET WASTE USING SAME

(76) Inventors: Tory Reynolds, Eden Prairie, MN (US); Connor Reynolds, Eden Prairie, MN (US)

( * ) Notice: Subject to any disclaimer, the term of this patent is extended or adjusted under 35 U.S.C. 154(b) by 0 days.

(21) Appl. No.: 12/378,307

(22) Filed: Feb. 13, 2009

(65) Prior Publication Data

US 2009/0271942 A1 Nov. 5, 2009

Related U.S. Application Data

(60) Provisional application No. 61/065,649, filed on Feb. 14, 2008, provisional application No. 61/065,650, filed on Feb. 14, 2008.

(51) Int. Cl.
*A47L 5/24* (2006.01)
*A01K 23/00* (2006.01)

(52) U.S. Cl. ..... 15/344; 15/327.2; 15/352; 15/DIG. 8

(58) Field of Classification Search ..... 15/327.2, 15/327.4, 327.6, 327.7, 344, 352; *A47L 5/24; A01K 23/00*

See application file for complete search history.

(56) References Cited

U.S. PATENT DOCUMENTS

| | | | | |
|---|---|---|---|---|
| 4,185,355 | A | 1/1980 | Williams | |
| 4,488,331 | A * | 12/1984 | Ward | 15/339 |
| 5,661,873 | A | 9/1997 | Karet | |
| 6,618,898 | B2 | 9/2003 | Tingle | |
| 7,003,846 | B2 | 2/2006 | Holtz | |
| 7,226,098 | B1 | 6/2007 | Moreira | |
| 7,472,456 | B2 | 1/2009 | Moore et al. | |
| 2008/0030032 | A1 | 2/2008 | Gill | |

FOREIGN PATENT DOCUMENTS

| | | |
|---|---|---|
| KR | 20-0293721 | 10/2002 |
| KR | 10-2005-0008402 | 1/2005 |

OTHER PUBLICATIONS

International Search Report & Written Opinion (PCT/US2009/000912) dated Oct. 5, 2009.

* cited by examiner

*Primary Examiner* — David A Redding
(74) *Attorney, Agent, or Firm* — Beck & Tysver PLLC

(57) ABSTRACT

A vacuum device for collecting pet waste includes a housing coupled to a vacuum source. The housing is a clam-shell configuration and is configured to receive a disposable liner bag. When closed, the housing holds the liner bag securely therein. A method of using the device provides for placing the liner bag within the housing, feeding a portion of the liner through an inlet tube to the housing, such that the inlet of the housing is insulated from contact with the waste being picked up.

5 Claims, 8 Drawing Sheets

PET WASTE VACUUM SYSTEM AND APPARATUS, DISPOSABLE LINERS THEREFOR, AND A METHOD OF COLLECTING PET WASTE USING SAME

This application claims the benefit of U.S. Ser. No. 61/065,649, filed Feb. 14, 2008 and U.S. Ser. No. 61/065,650, filed Feb. 14, 2008, both of which are incorporated herein in their entirety.

FIELD OF THE INVENTION

The present invention relates generally to a device for collecting pet waste, garbage or other material, and more particularly to a vacuum-actuated device for collecting pet waste, garbage or other material that accommodates a liner.

BACKGROUND OF THE INVENTION

Pet waste cleanup is a relatively unpleasant chore for pet owners; yet, failure to clean up pet waste poses environmental hazards due to polluted ground water. Typical devices for waste collection have included shovels, scoopers and bags. These devices can, however, be difficult to use, may require stooping, and become contaminated with waste during use.

SUMMARY OF THE INVENTION

What has been needed is a collection device and method that is easy to use, effective, and does not require cleaning after use.

A device, system and method employs a vacuum to collect pet waste, garbage or other material. The collection device includes a clam-shell housing that is coupled to and in fluid communication with the vacuum source. The housing is a clam-shell configuration with two sections hinged together and movable between an open position allowing easy access to the collection volume within and a closed position used in operation. In the closed position, the housing is vented to, or is in fluid communication with, the environment through an inlet tube that extends outwardly from the housing.

The system further incorporates a disposable liner that lines the housing that substantially prevents it from getting dirty during use. The liner bag, in use, collects and contains the pet waste or other material being picked up with the device. The liner bag is sized and shaped to reside largely within the housing. A portion of the liner, however, extends through the housing inlet tube and terminates in an inlet opening in the bag that is outside the housing during use.

In one embodiment, the inlet tube is defined in one section of the housing; the other section of the housing includes a collar that is sized and shaped to receive a portion of the inlet tube therein and to frictionally snap-fit the collar to the tube, with a portion of the liner bag squeezed or held therebetween. Further, this snap-fitting of the collar to the tube holds the two sections of the clam-shell housing in a closed position for use.

In one embodiment, the device is configured to allow use while standing, by including an extension tube extending between the housing and the vacuum source. Alternative arrangements for the device could be used, though this arrangement is advantageous in that the lion's share of the weight of the device is adjacent the user's hand, allowing greater control of the positioning of the device. Alternative embodiments of the device do not include an extension tube and yield a smaller device that may be advantageous for their overall small size.

BRIEF DESCRIPTION OF THE DRAWINGS

An exemplary version of a pet waste vacuum is shown in the figures wherein like reference numerals refer to equivalent structure throughout, and wherein.

DETAILED DESCRIPTION OF PREFERRED EMBODIMENT(S)

Figure 1:
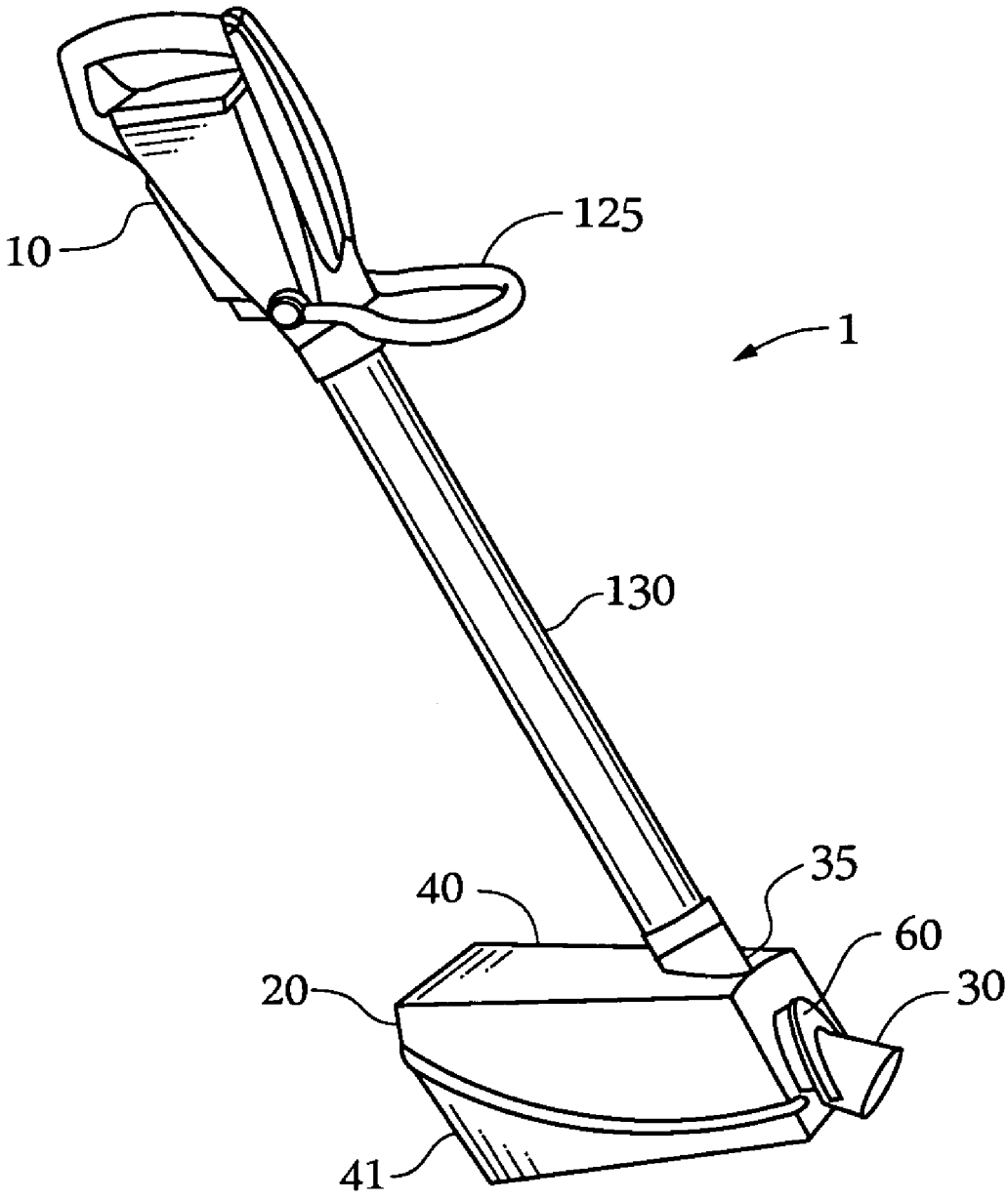
FIG. 1 is an elevated perspective view of a pet waste collection device according to the present invention, showing its housing in a closed position.

FIG. 1 shows one embodiment of a system and device 1 for collecting pet waste, garbage or other material. The device 1 includes a vacuum source 10 in fluid communication with a housing 20 generally enclosing a collection compartment or volume 25. More specifically, the housing 20 is generally enclosed but has one port or vent 30 to the environment and another port or vent 35 that connects directly or indirectly to the vacuum source 10. The vacuum source is preferably a fan powered by a battery, such as a rechargeable battery.

Figure 2:
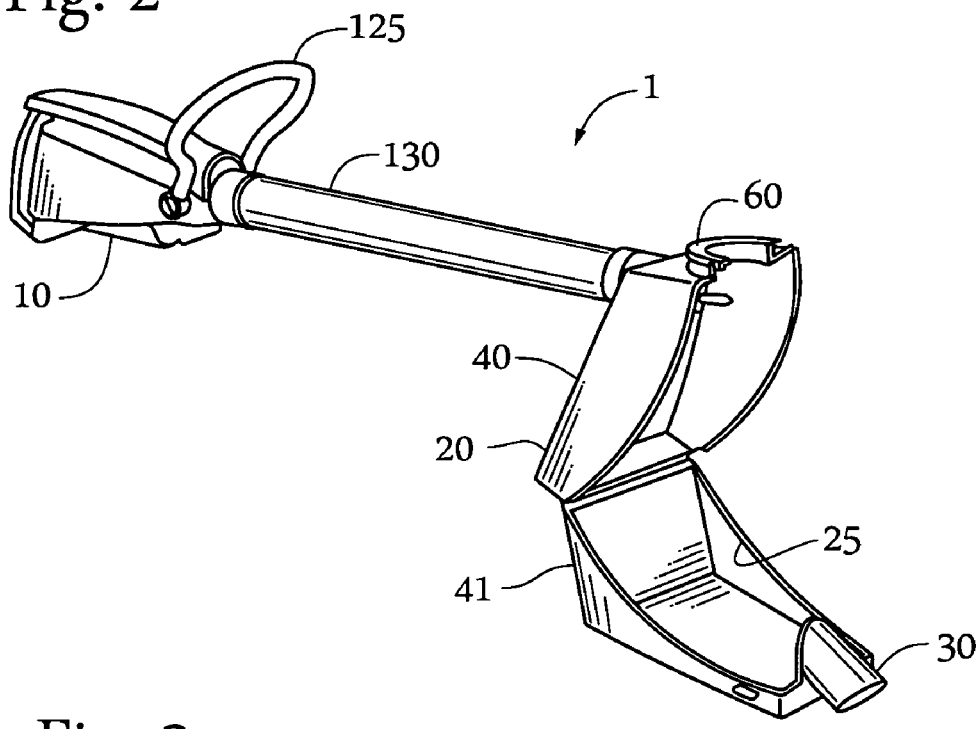
FIG. 2 is an elevated perspective view of the device of FIG. 1, with the housing shown in an open position.

In the embodiment depicted, the housing has a clam-shell configuration, with two sections 40, 41 hinged to one another and movable between a first position in which the housing is closed, as shown in FIG. 1, and open, as shown in FIG. 2, providing access to the collection volume 25.

The housing 20 includes an inlet tube 50. The inlet tube 50 extends outwardly from adjacent portions of the housing. It terminates in a housing inlet or mouth 51 having a size that is sufficiently large to allow entrance of pet solid waste of typical width, yet small enough that the suction of the vacuum works to optimal effect. The collection volume 25 is in fluid communication with the environment via the inlet tube 50. The inlet tube 50 is defined by one of the sections 40, 41 of the housing. In the embodiment depicted in the figures, the inlet tube is, specifically, defined by the bottom section 41.

The other section 40, shown in the figures as the top section of the housing in the embodiment depicted, defines a generally U-shaped collar 60 is sized and shaped to engage with the inlet tube 50 of section 41. In one embodiment, the inlet tube 50 and the collar 60 are sized and shaped such that the collar 60 receives at least a portion of the inlet tube and such that there is a friction fit or snap-fit between the two. To accomplish this, the U-shape of the collar 60 must be deep enough to circumscribe the inlet tube 50 at its diameter. In a preferred embodiment, the connection between the collar 60 and the inlet tube 50 achieves two functions. One of these functions is to hold the housing closed; that is, it holds the two sections 40, 41 of the housing in a closed position. The other function will be discussed below.

In the embodiment illustrated, the housing's port 35 to the vacuum is defined in the upper housing section 40. To minimize the possibility of collected waste passing through the port 35, a baffle 65 extends from the inner side of the wall of the housing into the collection compartment 25 and is located adjacent the port 35. In the embodiment shown, the baffle extends, more specifically, from the wall of section 40 of the housing, though in an alternate embodiment, not shown, it may extend from section 41. The baffle 65 is sized and shaped so as to not preclude fluid communication between the housing ports 30 and 35, but to protect the port 35 from debris passing into the port 35. In addition, a grill 67 covers the port 35.

Figure 3:
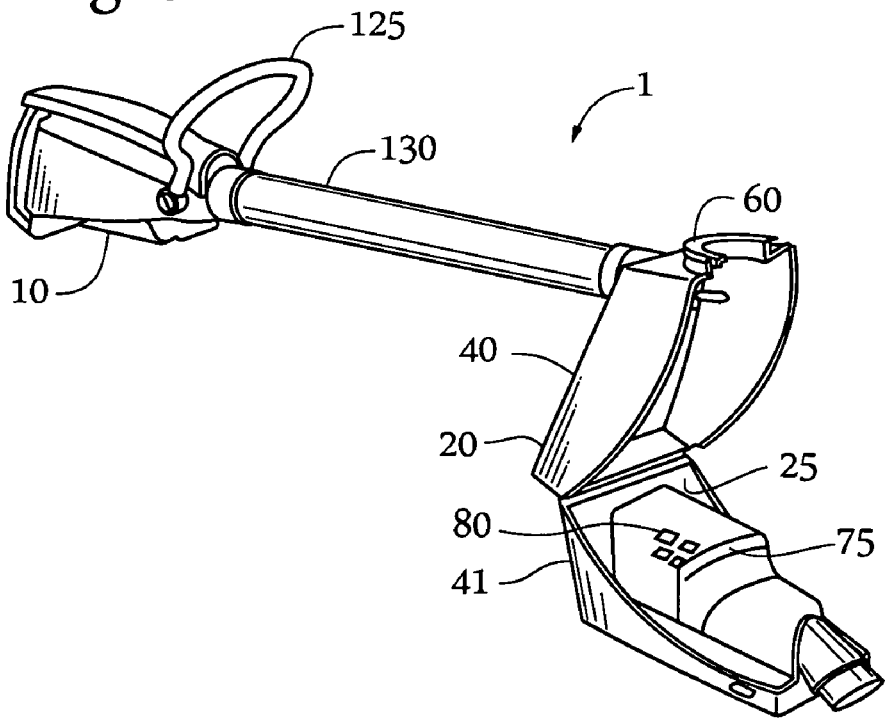
FIG. 3 is an elevated perspective view of the device of FIG. 1 with the housing shown in an open position and with a liner bag in place within a section of the housing.
Figure 4:
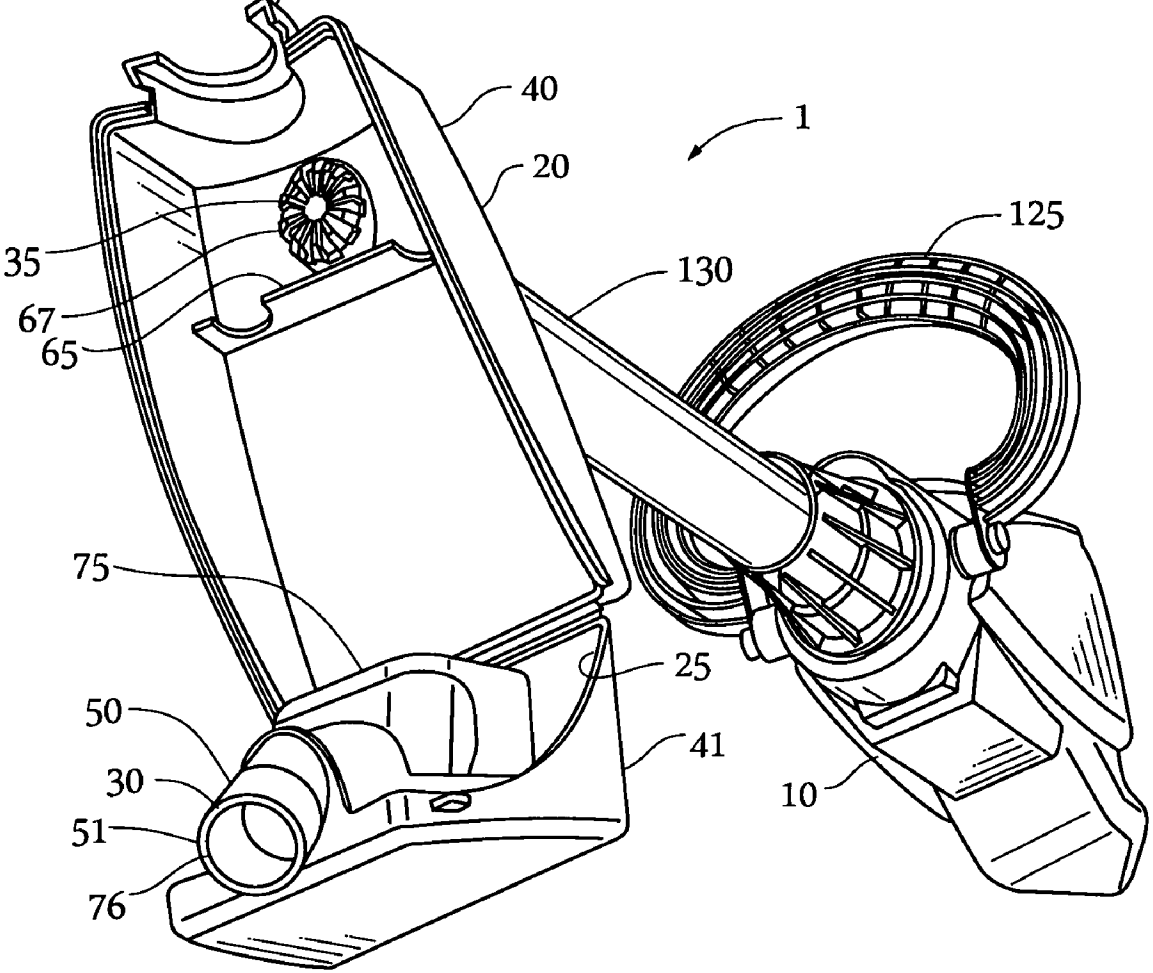
FIG. 4 is an elevated perspective view of the device of FIG. 1 taken from a different angle, with the housing shown in an open position and with a liner bag in place within a section of the housing.
Figure 5:
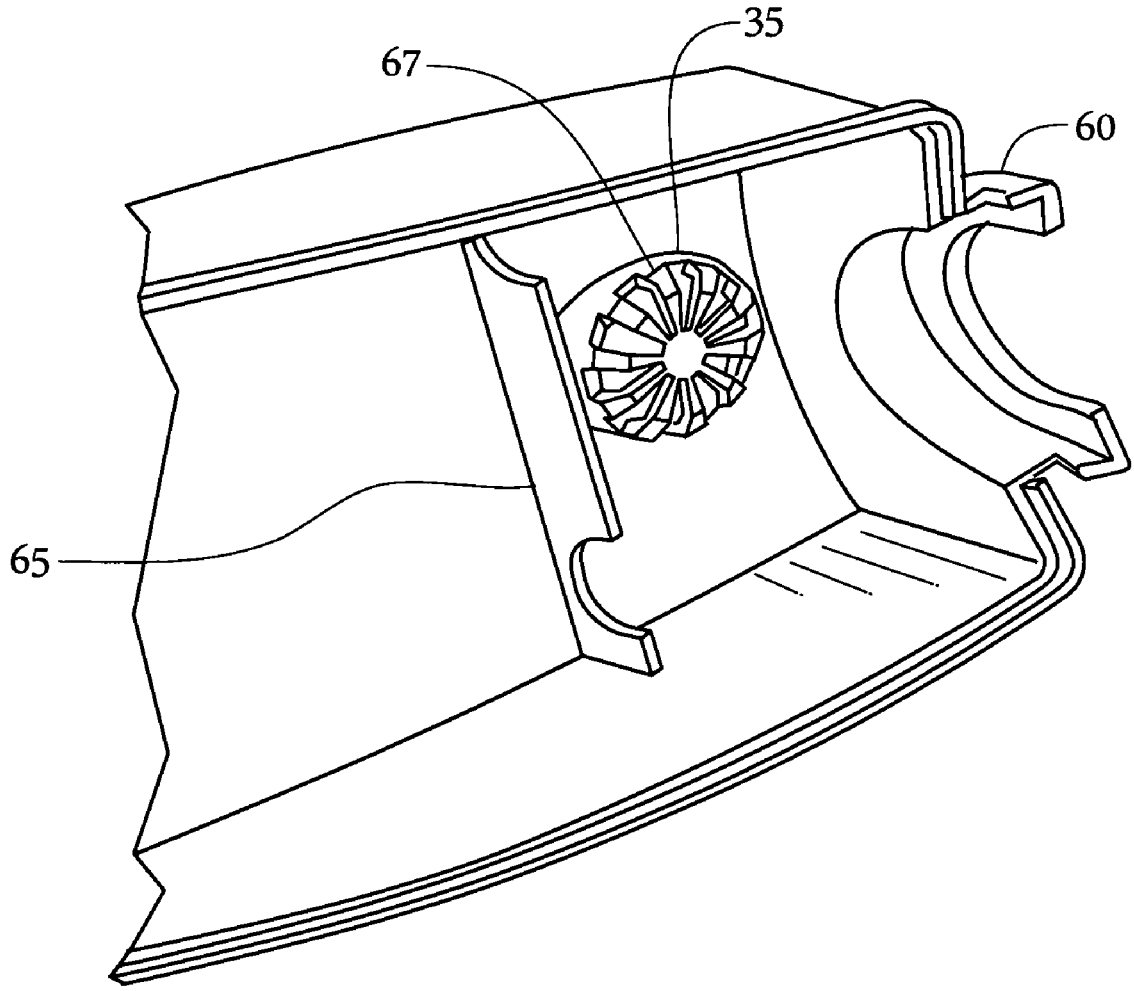
FIG. 5 is a close-up, partial view of a portion of the device of FIG. 1, showing a portion of the interior of a section of the housing.
Figure 6A:
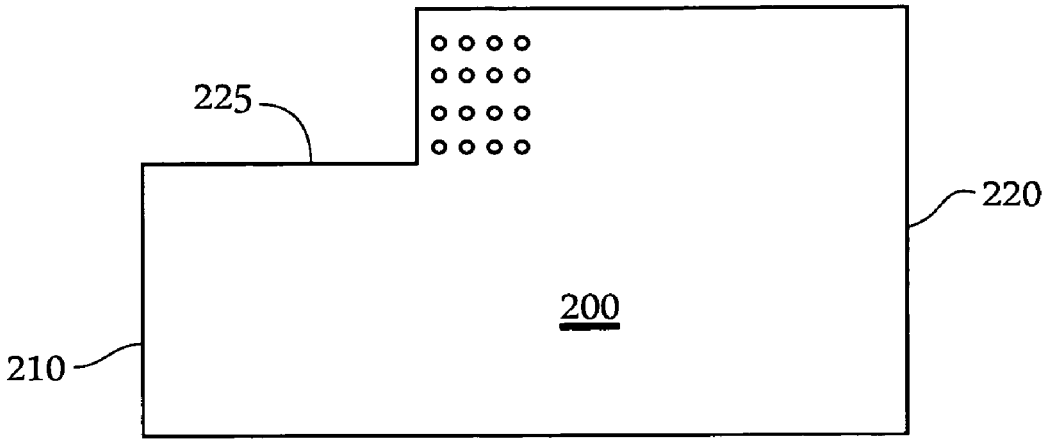
FIGS. 6*a-e* show alternative embodiments for a liner bag for use in conjunction with the device of FIG. 1.
Figure 6B:
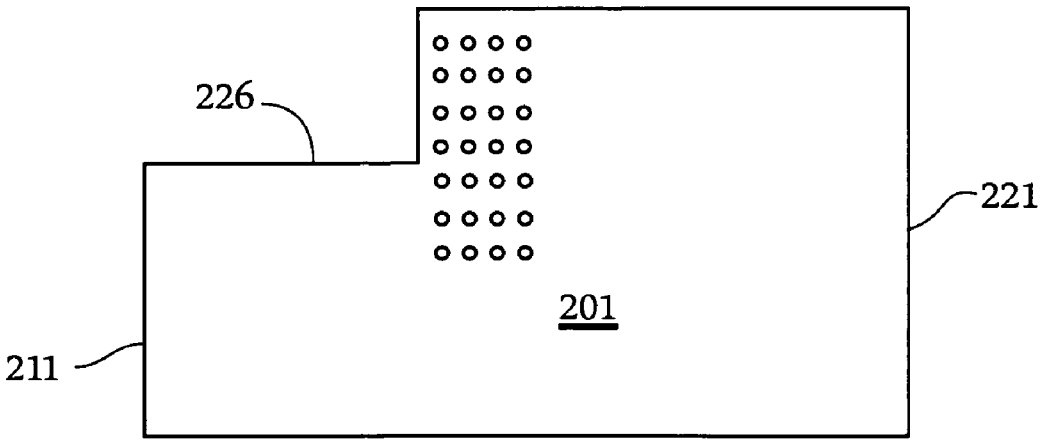
Figure 6C:
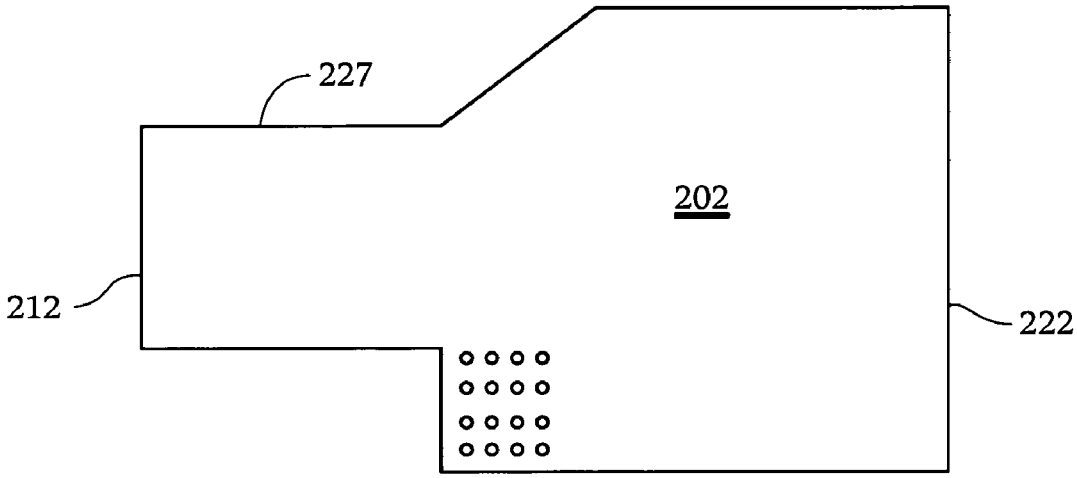
Figure 6D:
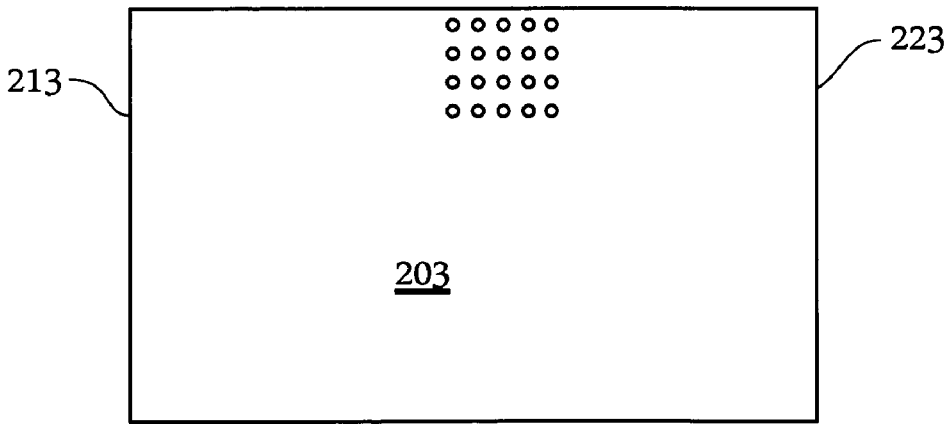
Figure 6E:
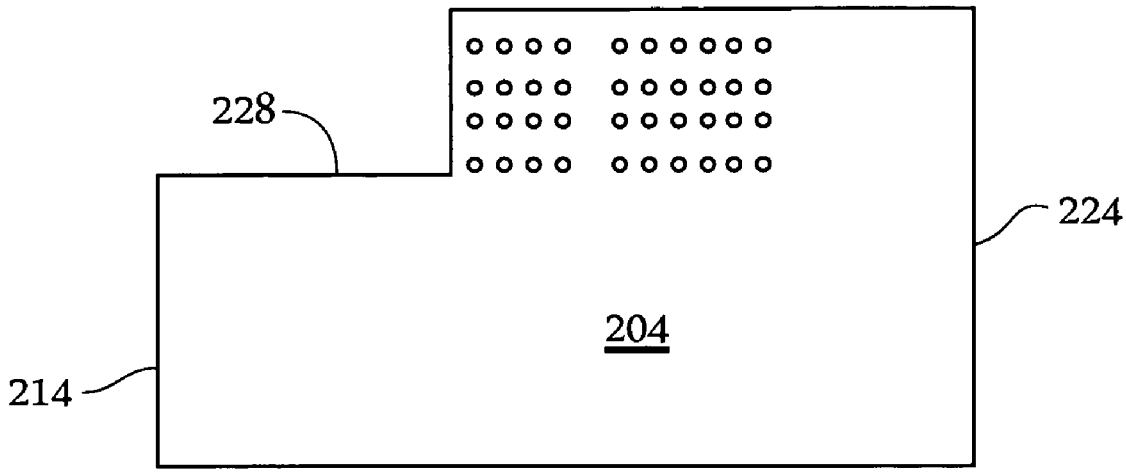

A disposable liner bag 75 is employed to line the container compartment 25 and the inlet tube 50 during use and to contain the collected pet waste for easy disposal. The liner bag 75 has an inlet 76. An exemplary bag 75 is shown in position in the housing 20 in FIGS. 3 and 4. The bag resides largely within the collection compartment 25; however, a portion of the bag extends through the inlet tube 50, thereby lining this tube. The bag folds over the end of the inlet tube 50. In this way, the portion of the device 10 that contacts pet waste during use, i.e. the end of the inlet tube 50, is protected or covered by the disposable liner bag, keeping the device 10 clean. The liner bag 75 defines apertures 80, FIG. 3, therein that allow fluid communication between the vacuum source 10 and the housing inlet 51. That is, via these apertures, suction force or negative pressure is transmitted from the vacuum 10 through the liner bag 75 to the inlet 51.

A variety of geometries of the bag 200, 201, 202, 203, 204 and the location of the apertures 80 are shown in FIGS. 6*a-e* in a flattened configuration. The bag 200-24 defines an inlet opening 210-214. The inlet opening 210-214 is opposite of the "bottom" of the bag 220-224, where "bottom" references the orientation of the bag after it is removed from the housing when it contains pet waste. The bag may include a neck portion 225, 226, 227, 228 or region of reduced diameter adjacent the inlet opening 210, 211,212, 214 as in the embodiments 200, 201, 202, 204 of FIGS. 6*a, b, c* and *e,* respectively. Alternatively, as shown in the embodiment 203 of FIG. 6*d*, the bag need not include a neck portion but instead may have the same diameter throughout its length. The bag 200-204 defines a group of apertures 250-254. The size of each aperture is small enough to prevent pet waste to pass therethrough, thereby keeping the housing 20 clean, but the aggregate area of the apertures 250-254 is large enough to allow the negative pressure exerted by the vacuum in use to readily be transmitted to the housing inlet 51. The size, shape, orientation and position of the aperture group may vary somewhat without adversely affecting performance. Positioning the aperture group midway along the length of the bag, or behind the neck region if the bag has one, offers advantages, as it is shown in all of the embodiments of FIGS. 6*a-e*: this is a region that the pet waste tends to pass by as it is sucked to the bottom 220-224 of the bag 200-204. It is also a region that is "above" the collected pet waste, after the filled liner is removed from the housing.

The bag is preferably formed of a biodegradable plastic. In one embodiment the apertures are die-cut with a loosely woven fabric covering the apertures that prevents solid particles from passing through the apertures, but allowing fluid communication thereacross.

The aforementioned baffle 65 and grill 67 in the housing 20 aids in preventing the liner bag 75 from being sucked through the port 35.

The device 10 may be configured to make it easy to use while standing. For example, the distance between the housing inlet 51 and the handle 125 may be selected such that a typical person would be able position the housing inlet 51 adjacent the ground while standing upright and holding the handle 125. Another consideration in making the device 10 comfortable for a user to use is to keep the weightiest portion of the device, that is the vacuum source, close to the user's hand. This makes the device more precisely maneuverable or easier to control than it would be with the weight away from the user's hands. One say to accomplish both of these design features, i.e. upright use and keeping the weight near the hand, is to extend the distance between the housing and the vacuum, such as by including an extension conduit 130 of a desired length that extends between the housing vacuum port 35 and the vacuum source 10.

In use, the user opens the housing 20 by hingedly displacing the top and bottom sections 40, 41 of the housing 20 from one another, revealing the collection compartment 25. The user then places a liner bag 75 into the compartment and pulls the neck portion of the liner (or the portion of the liner adjacent the liner's opening) through the inlet tube 50, so that the inlet of the bag is exterior to the containment compartment 25. The user folds a portion of the liner bag over the outside of the housing's inlet tube 50 so that the end of the inlet tube 50 is covered by the liner bag 75. The user then closes the housing; on closing, the collar 60 mates with the inlet tube 50 in a snap-fit friction fit, with the liner bag squeezed therebetween, thereby securing the liner bag in place and holding the two sections 40, 41 of the housing in the closed position. The user activates the vacuum source and positions the housing inlet 51 adjacent waste to be picked up. The negative pressure in the collection compartment 25 caused by the vacuum source 10 sucks the waste through the inlet 51 and into the liner bag 75 within the collection compartment 25. When the liner bag 75 is full or when the desired waste is collected, the user stops the vacuum source 10 and opens the housing 20. Touching the clear exterior of the liner bag 75 within the collection compartment, the user pulls the liner bag 75 back through the inlet tube. The previously exposed surface of the liner bag 75 is now inside the bag 75 and the bag's exterior surface has not come into contact with the collected waste and remains clean. The user then discards the liner bag with the contained waste.

Figure 7:
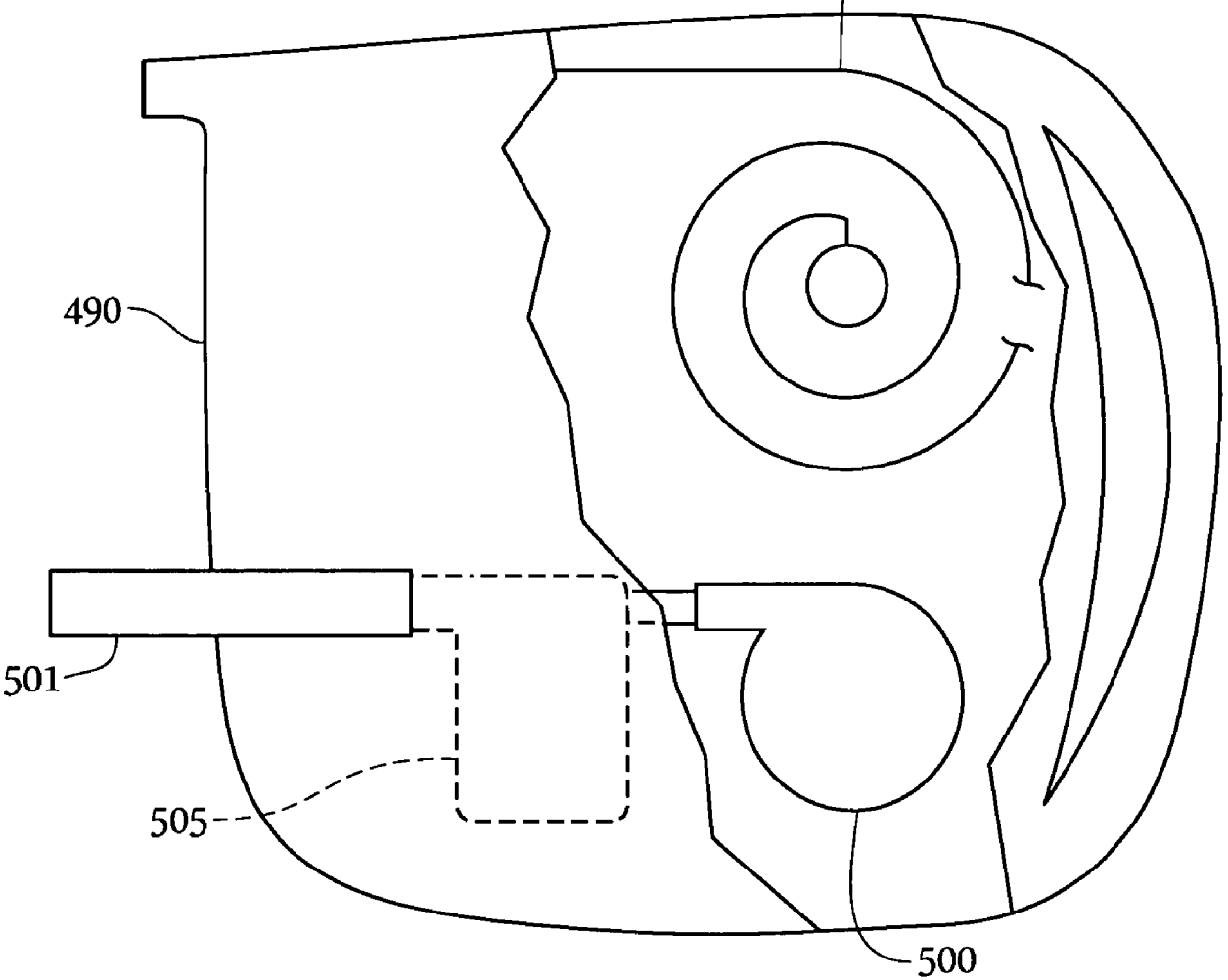
FIG. 7 is a schematic showing an alternative embodiment of a device for collecting pet waste.

In an alternative embodiment, FIG. 7, for use where a small size is deemed more important than being able to use the device while standing upright, the housing 490 is positioned adjacent the vacuum source 500 with little or no extension therebetween. In this embodiment a vacuum source 500 is coupled to an inlet port 501 via a collection compartment 505. The device may be coupled with a leash or a retractable leash 510.

Although an illustrative version of the device is shown, it should be clear that many modifications to the device may be made without departing from the scope of the invention. For example, in the describe embodiment, the friction fit between the inlet tube 50 and the collar 60 is used to hold the sections of the housing together; in an alternate embodiment, a latch might instead be employed elsewhere on the housing.

We claim:

1. A device for collecting pet waste, comprising:

a) a vacuum source;

b) a clam-shell housing coupled to said vacuum source, said housing having:

i) first and second ports, one of said ports venting to the environment and the other said port venting to said vacuum source;

ii) first and second sections hingedly connected to one another and movable between open and closed positions, and said housing defining a collection volume when said first and second sections are in the closed position;

iii) means for retaining a liner bag largely within said collection volume but extending out of said housing and terminating outside of the housing at an inlet opening.

2. A device for collecting pet waste according to claim 1 wherein said retaining means includes a portion of said first housing section that snap-fits with a portion of said second housing section in said closed position to squeeze a liner bag therebetween.

3. A device according to claim 2, wherein said snap fit between said first and second sections also holds said first and second sections in said closed position.

4. A device for collecting pet waste according to claim 1, wherein one of said sections has an inlet tube extending outwardly from said housing and wherein said other said section has a collar from said housing sized and shaped to snap fit to said inlet tube in a friction fit.

5. A method of lining a device for collecting pet waste, comprising the steps of:

a) providing a vacuum source;

b) providing a housing coupled to said vacuum source, said housing having:

i) first and second ports, one of said ports venting to the environment and the other said port venting to said vacuum source;

ii) first and second sections hingedly connected to one another and movable between open and closed positions, and said housing defining a collection volume when said first and second sections are in the closed position;

iii) one of said sections having an inlet tube extending outwardly from said housing and wherein said other said section has a collar extending outwardly from said housing sized and shaped to receive and couple to a portion of said inlet tube;

c) providing a liner bag having an inlet opening and vent holes;

d) positioning said liner bag largely within said collection volume but with a portion of said bag extending through said inlet tube with said bag inlet opening terminating exterior to said housing;

e) closing said housing such that said collar snapfits to said inlet tube with a portion of said liner bag clamped therebetween.

* * * * *